United States Patent [19]

Pohl

[11] Patent Number: 4,671,595

[45] Date of Patent: Jun. 9, 1987

[54] MULTIGAUGE-MULTIWIRE INSULATION DISPLACEMENT TERMINAL

[75] Inventor: Karl H. Pohl, Buffalo, Minn.

[73] Assignee: ADC Telecommunications, Inc., Bloomington, Minn.

[21] Appl. No.: 794,080

[22] Filed: Nov. 1, 1985

Related U.S. Application Data

[63] Continuation-in-part of Ser. No. 789,482, Oct. 21, 1985, abandoned.

[51] Int. Cl.[4] ..... H01R 4/24

[52] U.S. Cl. ..... 439/399; 439/408

[58] Field of Search ..... 339/97 R, 97 P, 98, 339/99 R

[56] References Cited

U.S. PATENT DOCUMENTS 4,624,521 11/1986 Vachhani ..... 339/97 P

*Primary Examiner*—Joseph H. McGlynn

*Attorney, Agent, or Firm*—Merchant, Gould, Smith, Edell, Welter & Schmidt

[57] ABSTRACT

A multigauge-multiwire terminal includes a first split cylinder portion providing a pair of jaws defining a continuous wire receiving slot and a second rib cage portion providing a plurality of opposing resilient ribs aligned to provide a discontinuous slot. In use a wire is inserted laterally of its length into the continuous slot, the jaws of which slice through the insulation on the wire and grippingly engages it. The insertion of another wire displaces the first inserted wire into the discontinuous slot in which it is gripped by the opposing ribs which generally provide for a three point contact with the conductor portion.

3 Claims, 8 Drawing Figures

MULTIGAUGE-MULTIWIRE INSULATION DISPLACEMENT TERMINAL

This is a continuation-in-part of U.S. Ser. No. 789,482, , filed Oct. 21, 1985, now abandoned.

TECHNICAL FIELD OF THE INVENTION

The present invention pertains generally to the field of telecommunications and more particularly to terminal blocks and modules.

BACKGROUND OF THE INVENTION

Insulation displacement terminals are widely used in the telecommunications industry for the interconnection of equipment and distribution lines. The terminals provide for a quick, mechanically secure and electrically sound connection without the use of solder, whereby large numbers of wires may be connected with a minimum of labor.

The typical prior art insulation displacement terminal consists of a metal cylinder which is "split" to provide a longitudinal seam or slot, with opposing sides of the cylinder forming a pair of jaws. As a wire is inserted into the slot laterally of its length the jaws slice through any insulation on the wire and crimpingly engage the conductor portion of the wire. More than one wire can be terminated between the jaws of the split cylinder provided that the wires are of the same gauge. However, if the wires are of different gauge, the larger diameter wire spreads the jaws of the terminal away from the smaller diameter wire resulting in a broken or intermittent connection. Thus, the typical prior art terminal cannot be used to terminate wires of different gauge.

In many applications, particularly newer ones, wires to be connected are of a uniform guage. Thus, the above-described terminal is well suited to the task. There are, however, many interconnection applications wherein the wire gauge is mixed, such that typical split cylinder terminals cannot be employed. Instead, wire wrap terminals which can accommodate a number of different gauges must be used. However, connecting wires via wire wrap terminals is less efficient than using insulation displacement terminals, making it a less desirable alternative. Accordingly, there is a need for a multiguage and multiwire insulation displacement terminal.

SUMMARY OF THE INVENTION

The present invention provides a multigauge-multiwire insulation displacement terminal which can terminate and connect two or more wires of different gauge. The terminal comprises a cylindrical hollow barrel portion including a longitudinal seam forming opposing jaws and defining a continuous wire receiving slot. A rib cage portion coaxially extends from the hollow barrel portion and includes a spine extending from the side of the barrel portion radially opposite the continuous slot. One or more transversely oriented ribs extend from the spine to respective free ends which are in radial alignment with the continuous slot. The free ends of the ribs are further aligned in opposition to one another to form a discontinuous slot which is in axial alignment with the continuous slot, with the free ends of opposing ribs offset from one another. A wire is inserted in the continuous slot laterally of its axis so that the jaws slice through any insulation on the wire and crimpingly engage the conductor portion of the wire. The wire may be displaced or pushed from the jaws into the discontinuous slot and be gripped by two or more opposing ribs. Accordingly, one or more wires may be held between the free ends of opposing ribs in the discontinuous slot with the individual ribs independently biased against the wires to accommodate wires of different gauges. And, another additional wire may thus be held between the jaws of the hollow barrel portion whereby two or more wires of different gauge may be terminated and connected.

According to another aspect of the invention the terminal is mounted within a generally cylindrical housing constructed of non-conductive material. The housing includes a bottom floor against which the bottom ribs of the rib cage portion may rest and a front wall adjacent the free ends of the ribs to provide axial and radial support for the ribs, respectively. Accordingly, deformation of the ribs by the application of axial force during insertion of a wire, or from the radially outward force applied when a wire which is pulled in the direction of its length outwardly from the terminal, is avoided. These and other salient features of the invention, including the more subtle aspects thereof, will be described in more detail in the ensuing specification.

DETAILED DESCRIPTION OF THE INVENTION

Figure 1:
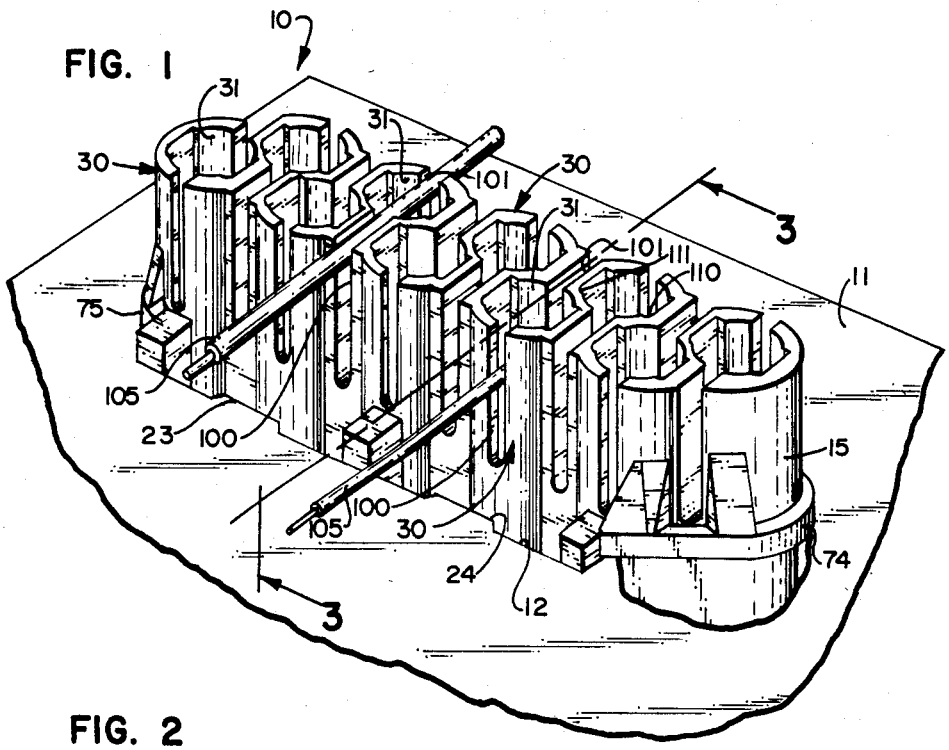
FIG. 1 is a perspective view of a connector block including the multigauge-multiwire terminal according to the present invention.
Figure 2:
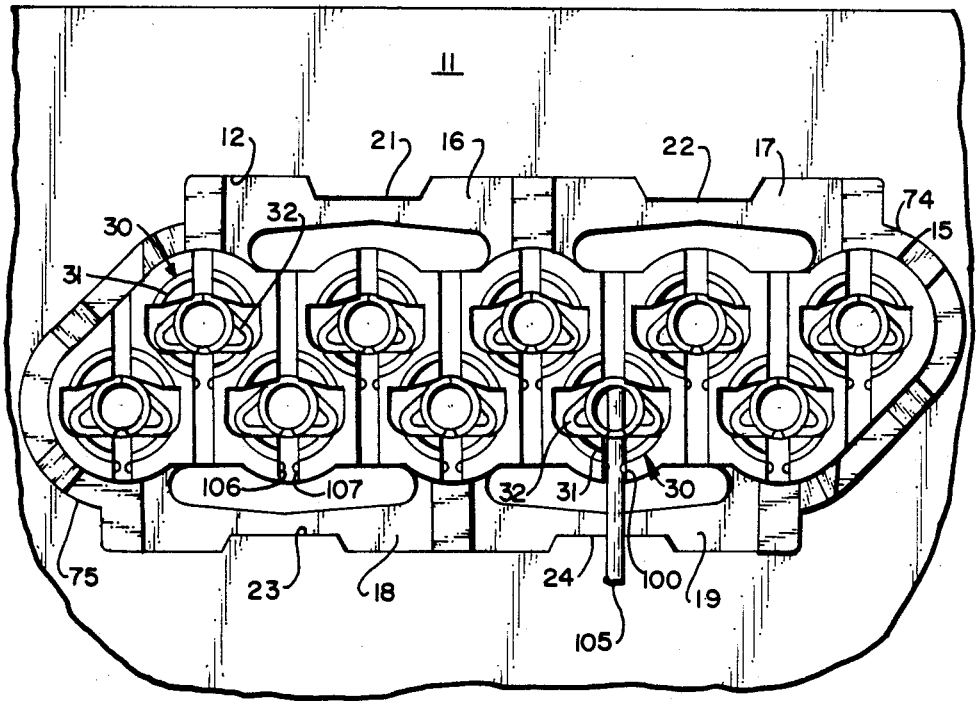
FIG. 2 is a top plan view of the connector block of FIG. 1.

The multigauge-multiwire insulation displacement terminal module according to the present invention is shown in perspective and plan views in FIGS. 1 and 2, respectively. Module 10 includes a housing 15 molded of relatively rigid non-conductive plastic, which is formed to provide ten cylindrical wire connector units 30. In use, module 10 is preferably mounted to a panel 11. For this purpose housing 15 includes a pair of mounting shoulders 74 and 75 and four flexible bridge members 16–19 which are adapted to flex past panel tabs 21–24, respectively, to permit snap-in mounting of module 10 in panel aperture 12.

Figure 3:
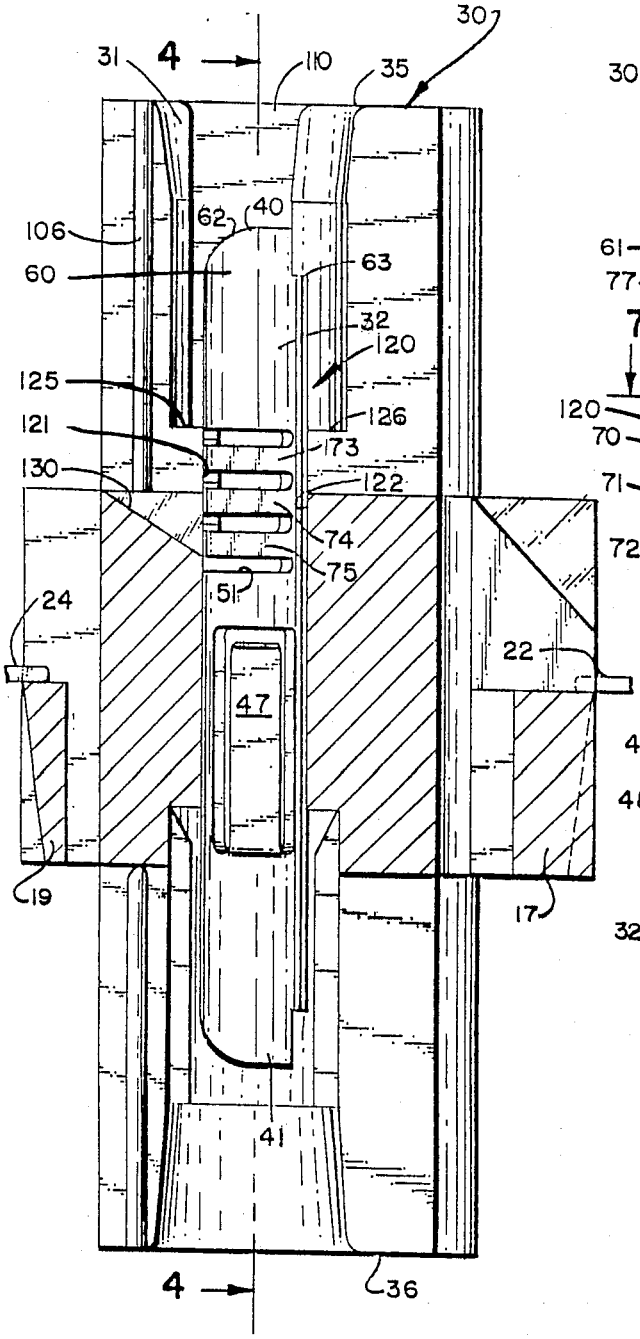
FIG. 3 is a cutaway side view of an individual terminal housing taken generally along the lines of 3—3 of FIG. 1.
Figure 4:
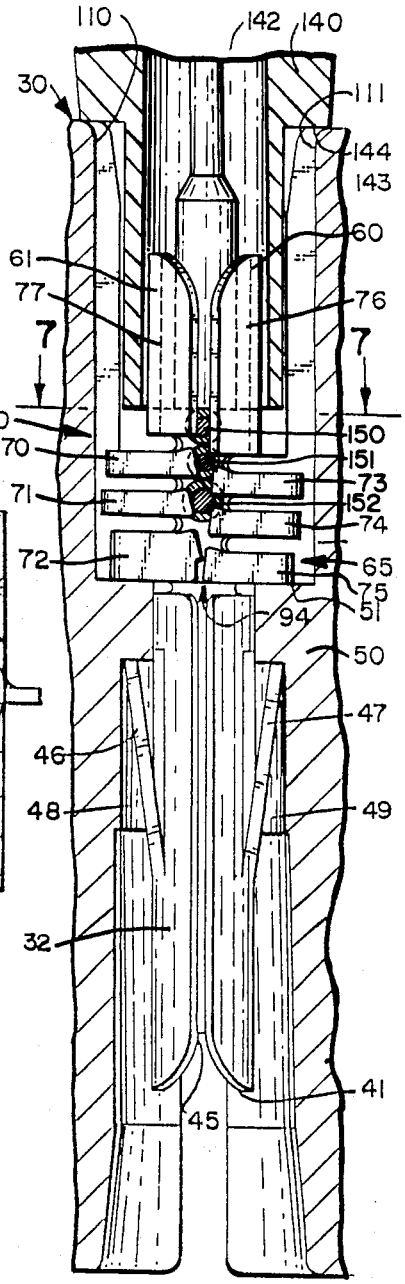
FIG. 4 is a cutaway front view of an individual terminal housing taken along the lines 4—4 of FIG. 3.

Referring now to FIGS. 3 and 4 in addition to FIGS. 1 and 2, a wire connector unit 30 according to the present invention will be described in more detail. Each wire connector unit 30 includes a cylindrical housing 31 which holds a stamped and formed metal terminal 32. Preferably, the cylindrical housings 31 are formed integrally with other housings as illustrated. Alternatively, however, the wire connector unit housings can be formed and mounted individually if desired. Housing 31 is generally cylindrical, and includes a first end 35 and a second end 36, such that module 10 is double-ended. Terminal 32 is also doubleended, including a first end 40 and a second end 41. As will be described in more detail below, end 40 is adapted to terminate two or more wires of different gauge, while end 41 is adapted to receive one or more wires of the same gauge.

In the preferred embodiment disclosed herein, end 41 of terminal 32 is adapted to terminate 22, 24 and 26 gauge wires, and is stamped and formed from 0.014 inch phosphor-bronze. Thus, certain dimensions for terminal 32 given herein relate to the material properties of phosphor-bronze. It is, however, contemplated that terminal 32 may be constructed of other metals and alloys having different properties provided that, to the extent necessary, material thickness and terminal dimensions are adjusted to compensate for differences in material strength, resiliency, hardness, etc. For example, it is currently contemplated that terminals may also be formed from beryllium-copper, nickel-silver and spring brass.

End 41 of terminal 32 and end 36 of housing 31 are of a design which was disclosed in co-pending application Ser. No. 658,268, filed Oct. 5, 1984, and entitled "Electrical Connector Module with Multiple Connector Housings", by Pohl. Accordingly, for the sake of brevity this aspect of the present invention will not be described in detail herein. Briefly then, end 41 of terminal 32 consists of a split cylinder design which includes a slot 45 into which wires may be inserted laterally of their length for termination and connection. In addition, end 41 includes a pair of tine members 46 and 47 which, as explained in more detail below, are for mounting terminal 32 in housing 31.

Figure 7:
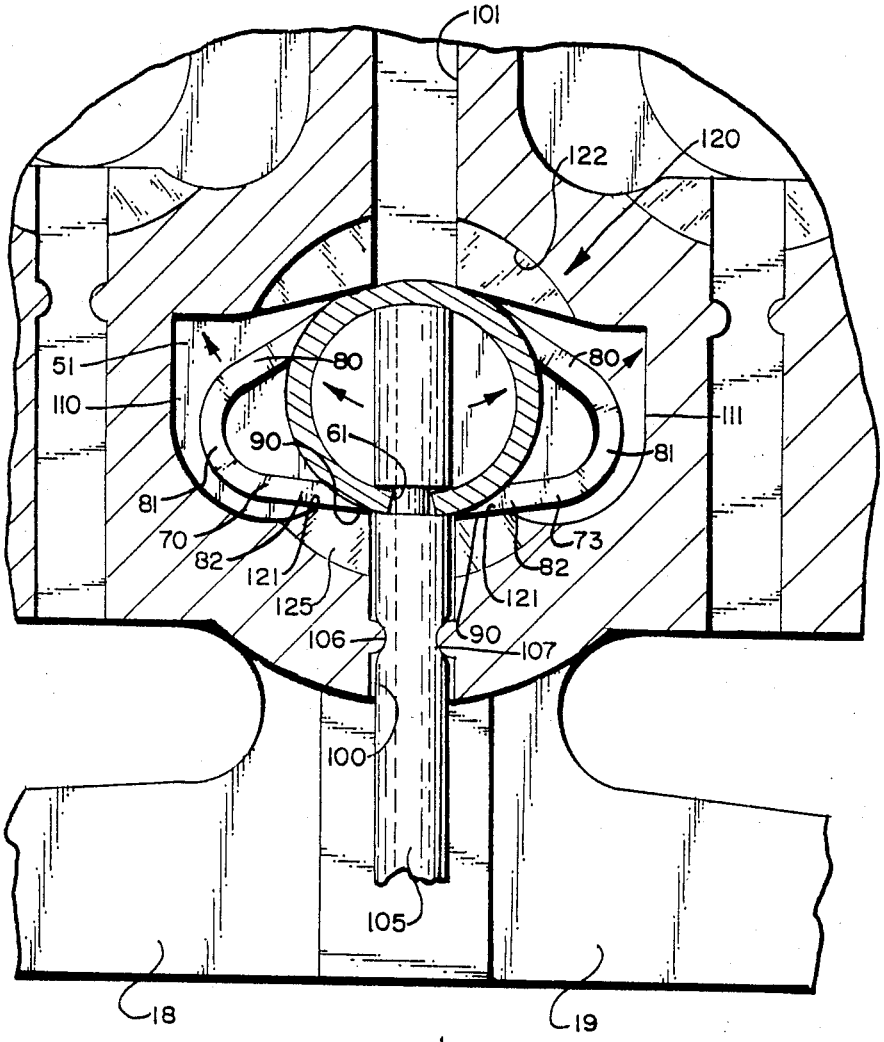
FIG. 7 is an enlarged plan view of an individual wire terminal and housing taken along lines 7—7 of FIG. 4.
Figure 8:
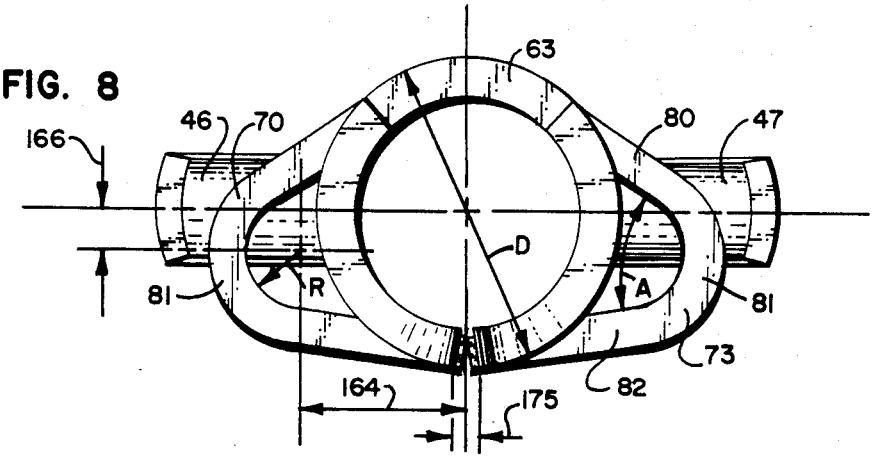
FIG. 8 is an enlarged plan top view of a wire terminal according to the present invention.

Referring now additionally to FIGS. 5, 6, 7 and 8, end 40 of terminal 32 will be explained in more detail. End 40 includes a first split cylinder portion 60 resembling a cylindrical hollow barrel. Preferably, portion 60 has an outside diameter D of 0.106 inches (FIG. 8). Portion 60 includes a longitudinal seam forming opposing jaws 76 and 77 and defining a continuous insulation displacing wire receiving slot 61 into which wires may be inserted laterally of their lengths. Preferably, slot 61 has a nominal width 175 of 0.006 inches (FIG. 8). As may be best seen with reference to FIG. 4, jaw 76 extends axially beyond the jaw 77. The top of slot 61 is flared outwardly to provide a wire guide 62 to funnel wires into slot 61 as they are inserted. On the top of cylinder portion 60, radially opposite slot 61, there is provided a recess 63 including a cutting edge for trimming the ends off wires as they are inserted.

End 40 of terminal 32 further includes a rib cage portion 65 including an arcuate spine 68 which extends from the rear wall 63 of portion 60, and a plurality of resilient ribs, or fingers, 70–75. As may be best seen with reference to ribs 70 and 73 as shown in FIG. 7, each of ribs 70–75 include a first extent 80 which extends tangentially away from arcuate spine 68, a bend 81 of acute angle, and a second extent 82, or free end, which is slightly inclined with respect to a line transverse and tangent to slot 61.

As may be seen best with reference to rib 70 in FIGS. 7 and 8, bend 81 preferably has a radius R of 0.019 inches. The centerpoint for radius R is preferably offset from the axis of terminal 32 a distance 164 of 0.060 inches and a distance 166 of 0.014 inches in the "x" and "y" directions, respectively. The angle A of bend 81 is preferably approximately 30 degrees. The circumferential width 165 of spine 68 is preferably 0.054 inches. With the exception of rib 72, extents 80 and 82 of ribs 70–75 are approximately 0.026 inches in width.

Figure 5:
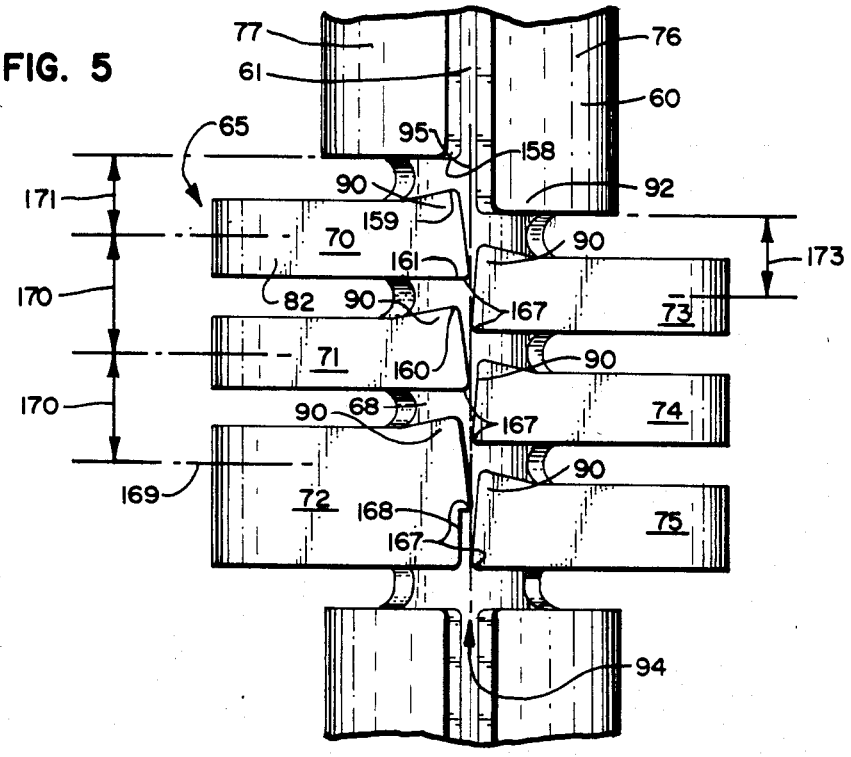
FIG. 5 is an enlarged front fragmentary view of the rib cage portion of the wire terminal according to the present invention.
Figure 6:
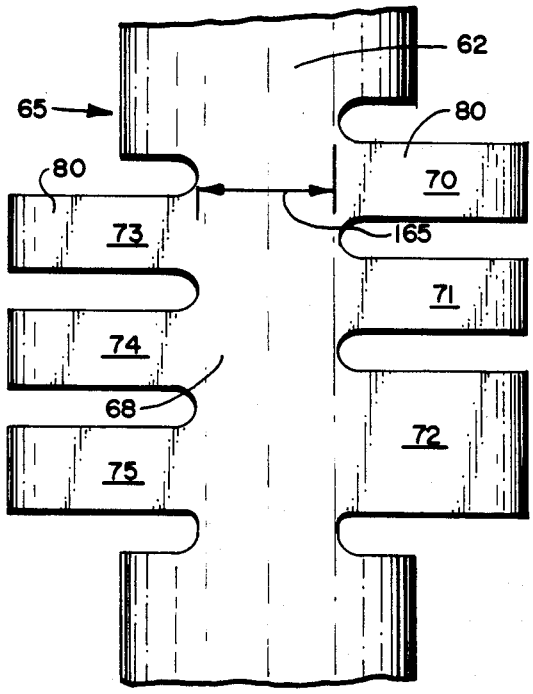
FIG. 6 is an enlarged rear fragmentary view of the wire terminal according to the present invention.

As may be best seen with reference to FIG. 5, each of ribs 70–75 are axially offset from one another, or staggered, and terminate at the offset, opposing tips 90, which have a generally flat or planar end profile. Rib 70, in addition to being opposed to ribs 73, is also opposed to a corner 92 of jaw 76 of cylinder portion 60. Each of ribs 70–75 are of substantially the same shape except for rib 72, which by virture of its "bottom" position is approximately twice the width of the remaining ribs. However, for the purpose of this description rib 72 is deemed to have a "centerline" 169 which assumes rib 72 is of similar width to the other ribs. Due to the excess width of rib 72, it includes a notch 168 which provides inward clearance for the corner 167 of rib 75.

Ribs 70–75 are aligned with respect to the axis of the terminal to form a discontinuous slot 94, the approximate centerline of which is illustrated with dotted-line 95. Preferably, the innermost extent 167 of tips 90 extend to the centerline of slot 94, such that if opposing ones of tips 90 where not offset they would just touch one another. It is contemplated, however, that opposing tips, in their relaxed condition, could be spaced apart up to 0.006 inches. Between longitudinally adjacent tips 90 and between tips 90 and the corners of jaws 76 and 77, for example between the points 160 and 161 of ribs 70 and 71, respectively, and between the corner 158 of jaw 77 and point 159 of rib 70, the preferred spacing is 0.006 inches maximum. The spacing 170 between the centerlines of longitudinally adjacent ribs is preferably 0.040 inches, while the offset between centerlines of opposing ribs 70 and 73, 71 and 74, and 72 and 75, is preferably 0.020 inches. Rib 70 is spaced a distance 171 of 0.027 inches to its centerline from the "bottom" edge of jaw 77, while rib 73 is spaced a distance 173 of 0.027 inches from the "bottom" edge of jaw 76.

Ribs 70–75 are generally resiliently flexible about spine 68 when they are spread away from slot 94. Thus, ribs 70–75 form a plurality of wire pincers. As will be explained below in more detail, discontinuous slot 94 is provided to receive up to two, and possibly three, wires pushed or displaced from slot 61. Accordingly, ribs 70–75 are formed to facilitate the movement of a wire through discontinuous slot 94 and to crimpingly engage the conductor portion of each wire as they travel in the slot, despite differences in their gauge.

To prevent wires from lodging between ribs, and to provide for the travel of wires through discontinuous slot 94, the tips 90 of ribs 70–75 are slightly enlarged or flared in order to narrow the gap between axially adjacent ribs. In addition, the edge of each tip is inclined approximately 13 degrees with respect to the centerline 95 of slot 94 so as to slope toward the centerline with respect to the direction of wire travel therealong, to prevent wires from catching on an edge of a rib.

Referring now to FIGS. 3, 4 and 7, the geometry of end 35 of housing 31 and the mounting of terminal 32 therein will be explained in more detail. End 35 is generally cylindrical in shape and includes a pair of diametrically opposed wire slots 100 and 101, one of which is aligned with slots 61 and 94 of terminal 32. As may be seen best with reference to FIGS. 1 and 2, slots 100 and 101 are for holding a wire in position before insertion, as in the case of wire 105. In addition, slot 100, or the slot which is aligned with the discontinuous slot 94 of a terminal 32, is designed to positively grip the insulation on an inserted wire to provide strain relief. For this purpose each of slots 100 include a pair of opposing lip portions 106 and 107 (see FIG. 2). The same strain relief system is also disclosed in the above-referenced U.S. patent application by Pohl, and reference may be had to that application for further details of this feature if desired.

The interior walls of end 35 of housing 31 are recessed on diametrically opposed sides to provide a pair of irregularly shaped channels 110 and 111. As may be best seen with reference to FIG. 7, channels 110 and 111 extend from the "top" of end 35 to the bottom floor 51 thereof. A nest portion 120 is provided at the bottom of end 35 and includes an inwardly protruding portion, or front wall, 121 and a rear wall 122, with the sides of the nest provided by the lower extent of channels 110 and 111. As may be best seen with respect to FIGS. 3 and 7, walls 121 and 122 each extend from the floor 51 to the respective ledges 125 and 126. Furthermore, the wall 121 is slotted intregally with slot 100, with the portion of the slot cutting through wall 121 having an inclined floor 130 which extends upwardly and outwardly from floor 51. While inclined floor 130 is provided in the preferred embodiment of the present invention, the incline is not essential to the invention. Rather, it is only necessary that the slot extend to floor 51 to provide for wire insertion to the bottom of the terminal 32. Wall 122 is slotted integrally with slot 101, but the slot does not extend to floor 51, as it is not required.

As may be best seen with reference to FIGS. 3 and 4, housing 31 includes an annular terminal retaining portion 50 which provides on one side floor 51 and on the other side a stop for tines 46 and 47. Housing 31 further includes diametrically opposed and longitudinally extending grooves 48 and 49. Accordingly, terminal 32 may be mounted in housing 31 by inserting it into end 35 and past retaining portion 50 so that tines 46 and 47 snap into place in grooves 48 and 49. Accordingly, terminal 32 is axially retained in housing 31 with ribs 72 and 75 resting on floor 51, and tine 46 and 47 on the opposite side of retaining portion 50. Tines 46 and 47, in cooperation with grooves 48 and 49, also provide for aligning the slots of terminal 32 with those of housing 31 and for restricting the rotation of terminal 32 in the housing.

As may be best seen with reference to FIG. 7, terminal 32 is mounted in housing 31 so that rib cage portion 65 is nested within nest 120, with the lower extent of spine 68 adjacent the rear wall 122 and with the free ends 82 of ribs 70–75 generally adjacent front wall 121. However, the tips 90 of free ends 82 protrude to a limited extent into the space interior of, or "behind", slot 61.

Thus, as described above, the present invention provides a multigauge-multiwire insulation displacement terminal. The embodiment illustrated herein is capable of connecting and terminating, on the rib caged end, up to three, and possibly four, wires of different gauge. However, the terminal is limited to terminating wires within a given range of gauge, although it may be adapted for different ranges. Presently, the terminal is known to be adaptable to a gauge range of approximately four. For example, the preferred embodiment disclosed herein may be used to terminate wires of gauges 22, 24, and 26. However, it could be adapted for 24, 26 and 28 etc. Nonetheless, the number of different wire gauges encountered in any given application is generally limited to two, and are usually either 22, 24 or 26 gauge. Accordingly, a terminal adapted to this gauge range may accommodate the majority of multigauge wiring applications. And, if desired, other ranges may be provided for by altering the width of and spacing between ribs 70–75 as required to accommodate differences in wire diameters. Moreover, it is contemplated that further "upper" ribs (70, 73) may be added to accommodate a greater number of wires, for example four or five, if desired.

In use, the connector unit 30 may be used to terminate up to at least three wires of different gauge, for example wires of 22, 24 and 26 gauge as shown in scale in FIG. 4, as follows. First, the wire to be installed is pulled into the top of slots 100 and 101 so that the wire is aligned to be inserted into slot 61 of cylinder portion 60 laterally of its length. Next, a wire insertion tool (140-FIG. 4) is used to push the wire down into cylinder portion 60 whereupon the wire is trimmed and the jaws 76 and 77 of the cylinder slice through and displace any insulation on the wire to grippingly engage the conductor portion of the wire. As shown in FIG. 4, there is typically some "pinching" of the conductor portion of the wire while transversing slot 61, such that the conductor acquires an oblong cross section. Preferably, as shown in FIG. 4, the tip 141 of tool 140 pushes the trimmed wire to the "bottom", or interior end, of slot 61 where it remains gripped between the jaws until displaced by a further wire. This position is illustrated by wire 150 (24 gauge) in FIG. 4. Briefly, tip 141 of tool 140 preferably includes a center insertion post 142 that fits inside barrel portion 60 of terminal 32 and a cylindrical sleeve portion 143 that fits concentrically around the outside of barrel portion 60. Tool 140 further includes stop shoulder 144 which limits penetration of tip 141 to the desired depth. For further details on wire insertion tool 140 reference may be had to the above-identified Pohl application. Of course, the invention is in no way limited with respect to the kind of wire insertion tool it is used with. For example, the wire insertion tool disclosed in the copending application entitled "Debris Ejecting Wire Insertion Tool", by Pedersen and Dewey, filed on even date herewith, may also be used in connection with the invention.

To insert another wire, the same process is repeated, whereupon the "second" wire pushes or displaces the previously inserted wire from between the jaws of cylinder portion 60 into discontinuous slot 94 where it comes to rest retained between the tips of the "top" ribs 70 and 73 and the corner 92 of jaw 76, as illustrated by wire 151 (26 gauge). Although not explicitly illustrated, it shall be understood that the tips of the ribs 70–75 track an inserted wire in the "grooves" sliced from the insulation by jaws 76 and 77. Thus, ribs 70–75 do not have to cut any more insulation from an inserted wire. And, the grooved insulation of an inserted wire facilitates keeping a wire in the desired alignment as it travels down the terminal.

As may be readily appreciated, up to two, or possibly three more wires may be terminated or connected in the above described manner, with each succeeding wire displacing the preceeding wires further into discontinuous slot 94. Thus, in the case where three wires are inserted as shown in FIG. 4, the bottom wires 152 (26 gauge) and 153 (22 gauge) are retained between the resilient ribs 70–75, which maintain a pincer-like two or three point contact, depending on the position of the wire in the slot, on the conductor portion of each wire. Thus, as may be readily appreciated, rib 70–75 may accommodate wires of different gauge by flexing to change position laterally of the slot (and the contour of slot 94) and by adjusting the point of contact of the rib with the conductor portion.

Preferably, each of ribs 70–75 has sufficient rigidity or strength with respect to the axis of terminal 32 so that they do not permanently deform as wires are pushed down into slot 94. To this end it has been found that a longer rib has a greater limit of elasticity with respect to movement thereof in an axial direction. However, if the ribs are compressed axially of terminal 32 they can "stack" on the bottom ribs 72 and 75, which are supported against movement on floor 51.

The connector unit according to the present invention provides that inserted wires may be extracted or disconnected from the terminal individually, which is an important feature for cross-connect panels which need to be frequently rewired. To this end the invention provides, as described above, that the free ends of ribs 70–75 abutt against front wall 121 of housing 31. Thus, a wire engaged by the rib cage portion 65 of terminal 32 may be extracted from between the free ends of the ribs by pulling it straight out of the terminal (as opposed to up and out) because front wall 121 provides a stop or support for the ribs which prevents the ribs from bending out and preventing deformation. However, the last inserted wire, which is held between the jaws 76 and 77 of cylinder portion 60, may be withdrawn simply by pulling it upwardly out of slot 61. It shall be understood that wall 121 could take other forms so long as it provides "outward" support for ribs 70–75.

Thus, the present invention provides a double-ended connector unit which may be used on one end to terminate and connect multiple wires of different gauge and on the other end to terminate one or more wires of the same gauge. Thus, the multigauge-multiwire terminal of the present invention provides an alternative to wire wrap terminals in applications involving more than one gauge of wire. Although the invention has been disclosed in its preferred form, it shall be understood that various changes and modifications may be made thereto without departing from the spirit and scope of the invention as set forth in the claims appended hereto.

What is claimed is:

1. A multigauge-multiwire insulation displacement wire terminal comprising:

a cylindrical hollow barrel portion including a longitudinal seam on a front side thereof, said seam forming opposing jaws and defining a continuous wire receiving slot into which wires may be inserted laterally of their lengths; and a rib cage portion extending coaxially from said barrel portion, said rib cage portion including a plurality of ribs with the free ends of said ribs aligned in opposition to one another to form a discontinuous slot which is in axial and radial alignment with said continuous slot, the free ends of opposing ribs offset from one another whereby a wire inserted in said continuous slot may be displaced into said discontinuous slot and be gripped by the free ends of said ribs.

2. A multigauge-multiwire insulation displacement wire terminal comprising:

(a) a cylindrical hollow barrel portion including a longitudinal seam on a front side thereof, said seam forming opposing jaws and defining a continuous wire receiving slot into which wires may be inserted laterally of their lengths;

(b) an arcuate spine extending axially from the rear wall of said barrel portion; and (c) a plurality of ribs each extending transversely from said spine to a free end, the free ends of said ribs aligned in opposition to one another to form a discontinuous slot which is in axial and radial alignment with said continuous slot, the free ends of opposing ribs offset from one another whereby a wire inserted in said continuous slot may be displaced into said discontinuous slot and be gripped by the free ends of said ribs.

3. A multigauge-multiwire insulation displacement wire connecting unit, comprising:

a terminal including:

(a) a cylindrical hollow barrel portion including a longitudinal seam on a front side thereof, said seam forming opposing jaws and defining a continuous wire receiving slot into which wires may be inserted laterally of their lengths;

(b) a rib cage portion extending coaxially from said barrel portion, said rib cage portion including a plurality of ribs with the free ends of said ribs aligned in opposition to one another to form a discontinuous slot which is in axial and radial alignment with said continuous slot, the free ends of opposing ribs offset from one another whereby a wire inserted in said continuous slot may be displaced into said discontinuous slot and be gripped by the free ends of said ribs; and a terminal housing including a substantially cylindrical top portion and a bottom nest portion, said top portion and bottom portion including a longitudinal wire slot, said terminal mounted in said housing with said continuous and discontinuous slots aligned with said housing slot and with said rib cage portion disposed in said nest portion, said nest portion including front wall means on either side of said housing slot in said nest portion proximate the free ends of said ribs for providing support for said ribs against radially outward movement so that an inserted wire may be extracted from said terminal in the direction of its length without deforming said ribs.

* * * * *